United States Patent [19]

Wise

[11] Patent Number: 4,941,988

[45] Date of Patent: Jul. 17, 1990

[54] LIQUID AUTOMATIC DISHWASHING COMPOSITIONS HAVING AN OPTIMIZED THICKENING SYSTEM

[75] Inventor: Rodney M. Wise, Cincinnati, Ohio

[73] Assignee: The Procter & Gamble Company, Cincinnati, Ohio

[21] Appl. No.: 310,812

[22] Filed: Feb. 13, 1989

[51] Int. Cl.[5] ..... C11D 7/16; C11D 7/20; C11D 7/56

[52] U.S. Cl. ..... 252/99; 252/95; 252/174.24; 252/174.25; 252/DIG. 14; 252/140

[58] Field of Search ..... 252/95, 99, 387, 135, 252/315.5, 174.24, 173, DIG. 14, 174.25

[56] References Cited

U.S. PATENT DOCUMENTS

| | | | |
|---|---|---|---|
| 3,755,180 | 8/1973 | Austin | 252/135 |
| 3,966,627 | 6/1976 | Gray | 252/99 |
| 4,740,327 | 4/1988 | Julemont et al. | 252/103 |
| 4,801,396 | 1/1989 | Altenschöpfer et al. | 252/99 |
| 4,836,946 | 6/1989 | Dixit | 252/97 |
| 4,836,948 | 6/1989 | Corring | 252/99 |

FOREIGN PATENT DOCUMENTS

| | | |
|---|---|---|
| 264975 | 4/1988 | European Pat. Off. . |
| 295093 | 12/1988 | European Pat. Off. . |
| 1333810 | 10/1973 | United Kingdom . |

*Primary Examiner*—Prince E. Willis

*Attorney, Agent, or Firm*—Gretchen R. Hatfield; Donald E. Hasse; Thomas H. O'Flaherty

[57] ABSTRACT

Disclosed are liquid automatic dishwashing detergent compositions having an optimized thickening system. The thickening system is based on a polyacrylate polymer thickener and an alkali metal silica colloid having dispersed therein an alkali metal aluminate.

14 Claims, No Drawings

LIQUID AUTOMATIC DISHWASHING COMPOSITIONS HAVING AN OPTIMIZED THICKENING SYSTEM

TECHNICAL FIELD AND BACKGROUND ART

This invention relates to aqueous automatic dishwashing detergent compositions which have a yield value and are shear-thinning. Compositions of this general type are known and disclosed in U.S. Pat. No. 4,116,851 to Rupe et al, issued Sept. 26, 1978; U.S. Pat. No. 4,431,559 to Ulrich, issued Feb. 14, 1984; U.S. Pat. No. 4,511,487 to Pruhs et al, issued Apr. 16, 1985; U.S. Pat. No. 4,512,908 to Heile, issued Apr. 23, 1985; Canadian Patent 1,031,229, Bush et al; European Patent Application 0130678, Heile, published Jan. 9, 1985; European Patent Application 0176163, Robinson, published Apr. 2, 1986; UK Patent Application 2,116,199A, Julemont et al, published Sept. 21, 1983; UK Patent Application 2,140,450A, Julemont et al, published Nov. 29, 1984; UK Patent Application 2,163,447A, Colarusso, published Feb. 6, 1986; UK Patent Application 2,164,350A, Lai et al, published Mar. 19, 1986; U.K. Patent Application 2,176,495A, Drapler et al, published Dec. 31, 1986; and U.K. Patent Application 2,185,037A, Dixit, published July 8, 1987.

U.S. Pat. No. 2,892,797, Alexander et al, issued June 30, 1959, teaches a process for modifying a silica sol to provide increased stability. This process comprises treatment with a metalate (e.g., sodium aluminate) solution. U.S. Pat. No. 3,255,117, Knapp et al, issued June 7, 1966, discloses automatic dishwashing detergent compositions in granular form containing an amphoteric metal compound, e.g., an aluminate. Similar disclosures are made in U.S. Pat. No. 3,350,318, Green, issued Oct. 31, 1967; U.S. Pat. No. 3,852,209, Hofmann, issued Dec. 3, 1974; U.S. Pat. No. 3,826,748, Finck, issued July 30, 1974; U.S. Pat. No. 2,575,576, Bacon et al, issued Nov. 20, 1951; U.S. Pat. No. 2,514,304, Bacon et al, issued July 4, 1950; U.S. Pat. No. 2,241,984, Cooper, issued May 13, 1941.

U.S. Pat. No. 3,755,180, Austin, issued Aug. 28, 1973, discloses a composition for use in an automatic dishwasher containing a precipitated silico-aluminate compound. (See also U.S. Pat. No. 3,966,627, Gray, issued June 29, 1976).

Sales literature for polyacrylates and Carbopol® resins by B. F. Goodrich discloses that using metal ions in combination with polyacrylate polymers can have a dilatory effect.

It has now been found that a polyacrylate thickening system in a liquid automatic dishwashing detergent composition can be enhanced by combining it with an alkali metal silica colloid having dispersed therein an alkali metal aluminate.

SUMMARY OF THE INVENTION

The compositions of this invention are thickened liquid automatic dishwasher detergent compositions comprising:

(1) from 0% to about 5%, preferably from about 0.1% to about 2.5%, of a preferably low-foaming, detergent surfactant;

(2) from about 5% to about 40%, preferably from about 15% to about 30%, of a detergency builder, especially a builder selected from the group consisting of sodium tripolyphosphate, sodium carbonate, potassium carbonate, potassium pyrophosphate, sodium pyrophosphate, and mixtures thereof;

(3) a chlorine bleach ingredient to yield available chlorine in an amount from 0%, preferably from about 0.3%, to about 2.5%, preferably from about 0.5% to about 1.5%;

(4) from about 0.25% to about 10%, preferably from about 0.5% to about 2%, of a polycarboxylate polymer thickening agent; and (5) from about 2% to about 15% preferably from about 3% to about 10%, on a solids basis, of an alkali metal silico-aluminate colloidal dispersion wherein the molar ratio of aluminum metal to $SiO_2$ is from about 0.01:1 to about 0.1:1, preferably from about 0.02:1 to about 0.06:1;

said composition having an apparent yield value of from about 40 to about 800, preferably from about 100 to about 600, dynes/cm$^2$.

DETAILED DESCRIPTION OF THE INVENTION

The thickening system of the present compositions is based on a polymeric thickener and a alkali metal silica colloid having dispersed therein an alkali metal aluminate.

Polymeric Thickener

The thickening agent in the compositions of the present invention is a high molecular weight polycarboxylate polymer thickener. By "high molecular weight" is meant from about 500,000 to about 5,000,000, preferably from about 750,000 to about 4,000,000.

The polycarboxylate polymer is preferably a carboxyvinyl polymer. Such compounds are disclosed in U.S. Pat. No. 2,798,053, issued on July 2, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, and pentaerythritol; more preferred are oligosaccharides, most preferred is sucrose. It is preferred that the hydroxyl groups of the polyol which are modified be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

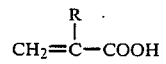

where R is a substituent selected from the group consisting of hydrogen and lower alkyl groups; most preferred is acrylic acid.

Various carboxyvinyl polymers are commercially available from B. F. Goodrich Company, New York, N.Y., under the trade name Carbopol. These polymers are also known as carbomers or polyacrylic acids. Carboxyvinyl polymers useful in formulations of the present invention include Carbopol 910 having a molecular weight of about 750,000, preferred Carbopol 941 having a molecular weight of about 1,250,000, and more preferred Carbopols 934 and 940 having molecular weights of about 3,000,000 and 4,000,000, respectively.

Carbopol 934 is a very slightly cross-linked carboxyvinyl polymer having a molecular weight of about 3,000,000. It has been described as a high molecular weight polyacrylic acid cross-linked with about 1% of polyallyl sucrose having an average of about 5.8 allyl groups for each molecule of sucrose.

Additional polycarboxylate polymers useful in the present invention are Sokolan PHC-25 ®, a polyacrylic acid available from BASF Corp. and Gantrez ® a poly(methyl vinyl ether/maleic acid) interpolymer available from GAF Corp.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymer keners for use in the present invention are the Carbopol 600 series resins available from B. F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agents. In fact, it has been found that if the polycarboxylate polymers of the present invention are utilized with clay in the composition of the present invention, a less desirable product results in terms of phase instability. In other words, the polycarboxylate polymer is preferably used instead of clay as a thickening/stabilizing agent in the present compositions.

The polycarboxylate polymer thickening agent in the compositions of the present invention is present at a level of from about 0.25% to about 10%, preferably from about 0.5% to about 2%.

The polycarboxylate polymer thickening agent provides an apparent yield value of from about 40 to about 800, and most preferably from about 100 to about 600, dynes/cm$^2$, to the present compositions.

The yield value is an indication of the shear stress at which the gel strength is exceeded and flow is initiated. It is measured herein with a Brookfield RVT model viscometer with a T-bar B spindle at 25° C. utilizing a Helipath drive upward during associated readings. The system is set to 0.5 rpm and a torque reading is taken for the composition to be tested after 30 seconds or after the system is stable. The system is stopped and the rpm is reset to 1.0 rpm. A torque reading is taken for the same composition after 30 seconds or after the system is stable.

Apparent viscosities are calculated from the torque readings using factors provided with the Brookfield viscometer. An apparent or Brookfield yield value is then calculated as: Brookfield Yield Value=(apparent viscosity at 0.5 rpm - apparent viscosity at 1 rpm)/100. This is the common method of calculation, published in Carbopol ® literature from the B. F. Goodrich Company and in other published references. In the cases of most of the formulations quoted herein, this apparent yield value is approximately four times higher than yield values calculated from shear rate and stress measurements in more vigorous rheological equipment.

Aluminate Dispersed in Silicate

A second key component in the improved thickening systems of the present invention is an alkali metal silica colloid having dispersed therein an alkali metal aluminate, hereinafter referred to as a silico-aluminate colloidal dispersion. It is this component which provides additional structuring to the polymeric thickener. Without wishing to be bound by theory, it is believed that the addition of the alkali metal aluminate to the polymer creates a discontinuity in the linear relationship between viscosity and yield, i.e., it allows for an increase in yield with relatively less increase in flowing viscosity. This allows for improved stability of suspended solids without increased dispensing difficulty. Furthermore, it allows for a reduction in the amount of polymer needed. This can mean a substantial reduction in production costs.

Other metalates, of amphoteric metals, e.g., zinc, beryllium, cadmium, lead, etc., will act similarly in the present invention, to provide this polymer structuring benefit. These alternative metalates are intended to be covered by the present invention as well. However, aluminate has been found to be a preferred execution of the present invention. Hence, the remaining disclosure of this invention will focus on the alkali metal aluminates.

The alkali metal aluminate is blended into an aqueous solution of an alkali metal silicate and the resultant colloid is incorporated with other components of the present compositions. The preferred structuring benefit of the present invention is seen when the aluminate is finely dispersed in the silicate, such that very little or no increased turbidity is visible in the mixture.

More specifically, the compositions of the present invention can be prepared as follows. The alkali metal aluminate (e.g., $xNa_2O.yAl_2O_3.zH_2O$) is first dissolved in water, for example, at a weight ratio of aluminate to water of about 1:20. Sodium aluminate is preferred, but other alkali metal salts of aluminate can be used. The aluminate solution, preferably warmed to above about 120° F., is then added with stirring to an aqueous sodium or potassium silicate solution. The silicate solution preferably comprises sodium silicate having an $SiO_2$:-$Na_2O$ weight ratio of from about 1:1 to about 3.6:1 in water at about 40–50 wt. % solids. Formulation of the present compositions with a metalate such as aluminate, assures that cationic metal ions, such as $Al^{+3}$ are not present to precipitate silicate under such mixing conditions. Some polymer structuring benefit has been seen when soluble amphoteric metal salts in cationic form are premixed with silicate prior to combination with other components of the composition. However, the above mentioned problem of formation of insolubles makes this a much less preferred embodiment of the present invention. This is particularly true for aluminum salts. Mixing should continue for about one minute or long enough to assure a homogeneous, fine dispersion of the alkali metal aluminate in the silica colloid formed. The addition of alkali metal hydroxide to this mixture during formation is useful to ensure stability of the colloid for extended storage times.

From about 2% to about 15%, preferably from about 3% to about 10%, on a solids basis, of the silico-aluminate colloidal dispersion, is added to the polyacrylate polymer thickener to get the additional structuring. The molar ratio of aluminum metal to $SiO_2$ in the colloidal dispersion formed should be from about 0.01:1 to about 0.1:1, preferably from about 0.02:1 to about 0.06:1, to get the best structuring benefits.

Bleach-Stable Detergent Surfactants

The compositions of this invention can contain from 0% to about 5%, preferably from about 0.1% to about 2.5%, of a bleach-stable detergent surfactant.

Desirable detergent surfactants, in general, include nonionic detergent surfactants, anionic detergent surfactants, amphoteric and zwitterionic detergent surfactants. and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (less than 5%) are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 6,000; 4,500; 3,400; and 1,450. All of these materials are wax-like solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)_y(C_2H_4O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO\text{-}(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $\text{-}(C_yH_{2y}O)_nH$ wherein y is 3 or 4 and n is a number from one to about 4.

Particularly suitable surfactants are the low-sudsing compounds of (4), the other compounds of (5), and the $C_{17-19}$ materials of (1) which have a narrow ethoxy distribution.

In addition to the above mentioned surfactants, other suitable surfactants for detergent compositions can be found in the disclosures of U.S. Pat. No. Nos. 3,544,473, 3,630,923, 3,888,781 and 4,001,132, all of which are incorporated herein by reference.

Some of the aforementioned surfactants are bleach-stable but some are not. When the composition contains a hypochlorite bleach it is preferable that the detergent surfactant is bleach-stable. Such surfactants desirably do not contain functions such as unsaturation and some aromatic, amide, aldehydic, methyl keto or hydroxyl groups which are susceptible to oxidation by the hypochlorite.

Bleach-stable anionic surfactants which are especially resistant to hypochlorite oxidation fall into two main groups. One such class of bleach-stable anionic surfactants are the water-soluble alkyl sulfates and/or sulfonates, containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble betaine surfactants. These materials have the general formula:

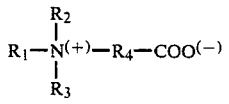

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Nonionic surfactants useful herein include ethoxylated and/or propoxylated nonionic surfactants such as those available from BASF Corp. of New Jersey. Examples of such compounds are polyethylene oxide, polypropylene oxide block copolymers sold under the trade names Pluronic ® and Tetronic ® available from BASF Corp.

Preferred members of this class are capped oxyalkylene oxide block copolymer surfactants of the following structure:

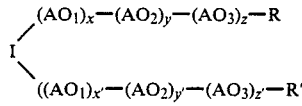

where I is the residue of a monohydroxyl, dihydroxyl, or a polyhydroxyl compound; $AO_1$, $AO_2$, and $AO_3$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R′ are hydrogen, alkyl, aryl, alkyl aryl, aryl alkyl, carbamate, or butylene oxide; w is equal to zero or one; and z, x′, y′, and z′ are greater than or equal to zero.

Other bleach-stable surfactants include amine oxides, phosphine oxides, and sulfoxides. However, such surfactants are usually high sudsing. A disclosure of bleach-stable surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable bleach-stable surfactants are the alkyl phosphonates, taught in U.S. Pat. No. 4,105,573, to Jacobsen, issued Aug. 8, 1978, incorporated herein by reference.

Still other preferred bleach-stable anionic surfactants include the linear or branched alkali metal mono- and/or di-($C_{8-14}$) alkyl diphenyl oxide mono- and/or disulphonates, commercially available under the trade names Dowfax 3B-2 (sodium n-decyl diphenyloxide disulfonate) and Dowfax 2A-1. These and similar surfactants are disclosed in published U.K. Patent Applications 2,163,447A; 2,163,448A; and 2,164,350A, said applications being incorporated herein by reference.

Bleaching Agent

The instant compositions optionally and desirably include a bleaching agent which yields a hypochlorite species in aqueous solution. The hypochlorite ion is chemically represented by the formula $OCl^-$. The hypochlorite ion is a strong oxidizing agent, and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials are available as aqueous solutions.

If present, the above-described bleaching agents are dissolved in the aqueous liquid component of the present composition. Bleaching agents can provide from 0%, preferably from about 0.3%, to 2.5% available chlorine by weight, preferably from about 0.5% to about 1.5% available chlorine, by weight of the total composition.

Buffering Agent

In the instant compositions, it is generally desirable to also include one or more buffering agents capable of maintaining the pH of the compositions within the alkaline range. It is in this pH range that optimum performance of the bleach and surfactant are realized, and it is also within this pH range wherein optimum composition chemical stability is achieved.

When the essential thickening agent is a clay material, and when a hypochlorite bleach is optionally included in the instant compositions, maintenance of the composition pH within the 10.5 to 2.5 range minimizes undesirable chemical decomposition of the active chlorine, hypochlorite-yielding bleaching agents, said decomposition generally being encountered when such bleaching agents are admixed with clay in unbuffered aqueous solution. Maintenance of this particular pH range also minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, potassium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Combination of these buffering agents, which include both the sodium and potassium salts, may be used. This may include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from about 2% to 20% by weight, preferably from about 5% to 15% by weight, of the total composition.

Detergency Builder

Detergency builders are desirable materials which reduce the free calcium and/or magnesium ion concentration in a surfactant containing aqueous solution. They are used herein at a level of from about 5% to about 40%, preferably from about 15% to about 30%. Generally the detergency builder used in liquid automatic dishwashing detergent compositions like those of the present invention, is sodium tripolyphosphate in an amount from about 10% to about 40%, preferably from about 15% to about 30%. Generally a certain percentage of the sodium tripolyphosphate is in an undissolved particulate form suspended in the rest of the detergent composition. A phosphate ester, if present in the composition, works to keep such solid particles suspended in the aqueous solution.

The detergency builder material can be any of the detergent builder materials known in the art which include trisodium phosphate, tetrasodium pyrophosphate, sodium tripolyphosphate, sodium hexametaphosphate, potassium pyrophosphate, potassium tripolyphosphate, potassium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, sodium carboxymethyloxymalonate, polyphosphonates, salts of low molecular weight carboxylic acids, and polycarboxylates, polymeric carboxylates such as polyacrylates, and mixtures thereof.

Some of the above-described buffering agent materials additionally serve as builders. It is preferred that the buffering agent contain at least one compound capable of additionally acting as a builder.

Other Optional Materials

The compositions of the present invention may optionally comprise certain esters of phosphoric acid (phosphate ester). Phosphate esters are any materials of the general formula:

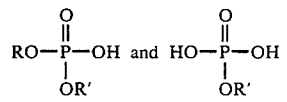

wherein R and R′ are $C_6$–$C_{20}$ alkyl or ethoxylated alkyl groups. Preferably R and R′ are of the general formula: alkyl-$(OCH_2CH_2)Y$ wherein the alkyl substituent is $C_{12}$–$C_{18}$ and Y is between 0 and about 4. Most preferably the alkyl substituent of that formula is $C_{12}$–$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Oxidental Chemical Corp.). Most preferred for use in the present invention is Hostophat-TP-2253 (Hoescht).

The phosphate esters useful herein provide protection of silver and silver-plated utensil surfaces. The phosphate ester component also acts as a suds suppressor in the anionic surfactant-containing detergent compositions disclosed herein.

If a phosphate ester component is used in the compositions of the present invention, it is generally present from about 0.1% to about 5%, preferably from about 0.15% to about 1.0% of the composition.

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents if such bleaching agents are also present.

If present, the above-described other optional materials generally comprise no more than about 10% by weight of the total composition and are dissolved, suspended, or emulsified in the present compositions.

Preferred Compositions A particularly desirable embodiment of the base composition for the present invention is a liquid automatic dishwashing composition which is essentially a single-phase clear gel. This is achieved by making a minimum molar substitution of 45–60% of the sodium ions typically present in such compositions with potassium ions. This solubilizes builder and electrolyte anions. Such a composition would be thickened with a polymeric thickener such as a polyacrylate instead of a clay thickener, since the latter would opacify the formula. Such compositions provide advantages with respect to physical shelf stability, dissolution rate, dispersing fluidity, and retention of product in the package vs. formulas which contain suspended salt solids. The sodium ions present in solution generally come from the sodium tripolyphosphate, sodium carbonate, sodium silicate, and sodium hydroxide. The molar substitution of alkali metal cations can be achieved by substituting therefor tetra potassium polyphosphate, potassium hydroxide, potassium carbonate, potassium bicarbonate, or potassium silicate. Particularly preferred compositions of this invention are liquid automatic dishwasher detergent compositions comprising:

(a) from about 4% to about 8% of sodium tripolyphosphate;
(b) from about 8.0% to about 15% of tetra potassium pyrophosphate;
(c) from 0% to about 8% of potassium carbonate;
(d) from 0% to about 6% of sodium carbonate;
(e) hypochlorite bleach in an amount to provide from about 0.5% to about 1.5% of available chlorine to the composition;
(f) from about 0.1% to about 2.5% of a bleach-stable surfactant;
(g) from 0 to about 3.5% of alkali metal hydroxide;
(h) from 0%, preferably from about 0.1%, to about 1% of an alkyl ester of phosphoric acid;
(i) from about 0.5% to about 1.5% of a polyacrylic polymer having a molecular weight greater than 750,000; and
(j) from about 2% to about 15%, on a solids basis, of an alkali metal silico-aluminate colloidal dispersion wherein the molar ratio of aluminum metal to $SiO_2$ is from about 0.02:1 to about 0.06:1;

said liquid detergent containing no clay suspending agents and having an apparent yield value of from about 100 to about 600 dynes/cm$^2$.

Method of Preparation

The compositions of the present invention may be prepared by any known method for the preparation of liquid automatic dishwashing detergent compositions. The silico-aluminate colloidal dispersion is simply substituted for traditionally used silicate in such compositions.

Alternatively, an alkali metal aluminate which contains sufficient alkalinity to ensure aqueous solution clarity can be added (with vigorous stirring) to silicate which already contains some or all of the other composition ingredients, and the absence of cationic aluminum will allow silico-aluminate formation and avoid uncontrolled precipitation of the aluminum by other anions.

As used herein, all percentages, parts, and ratios are by weight unless otherwise stated.

The following Examples illustrate the invention and facilitate its understanding.

EXAMPLE I

An alkali metal silica colloid having a fine dispersion therein of sodium aluminate is prepared as follows:

| Component | Wt. % |
|---|---|
| Sodium silicate (2.4R) slurry (47.3% in $H_2O$) | 72.83 |
| Sodium aluminate ($Na_2O.Al_2O_3.3H_2O$) | 1.36 |
| Distilled water | 25.81 |

The sodium aluminate is first dissolved at 5 wt. % in distilled water. The silicate slurry is placed into the stainless steel container of a Waring Commercial Blender. The blender is set on high speed, and the sodium aluminate solution is slowly added to the silicate slurry in the blender and mixed for 1 to 2 minutes total.

This produces a sodium silicate colloid having a very fine dispersion of sodium aluminate contained therein. This colloidal dispersion can be used to prepare liquid automatic dishwashing detergent compositions comprising polyacrylate thickeners to provide enhanced structure to the polymer thickener system.

EXAMPLE II

The following is a liquid automatic dishwashing composition of the present invention.

| Component | Formula Parts, % of Active Ingredients |
|---|---|
| Sodium tripolyphosphate (STPP) | 4.67 |
| Tetrapotassium pyrophosphate (TKPP) | 12.60 |
| Sodium silicate (2.4 ratio) | 3.27 |
| Potassium carbonate ($K_2CO_3$) | 3.39 |
| Sodium carbonate ($Na_2CO_3$) | 3.01 |
| Available chlorine from sodium hypochlorite | 0.93 |
| Potassium hydroxide (KOH) | 0.84 |
| Monostearylacidphosphate (MSAP) | 0.03 |
| Polyacrylic acid (PAA) | 0.65 |
| Sodium aluminate | 0.14 |
| Perfume, dye, water | Balance |

The level of sodium aluminate ($Na_2O.Al_2O_3.3H_2O$), containing 43.5% $Al_2O_3$, may be varied in the composition to deliver up to 0.06% $Al_2O_3$. The aluminate is dissolved in KOH at about 200° F. or water at about 102° F. and then added to the aqueous silicate using the method described in Example I to form a stable silico-aluminate colloidal dispersion. All other ingredients except perfume, dye, MSAP, and PAA are mixed vigorously with the remaining water to form a clear solution. This solution is stirred into a predispersed gel mixture of 3.4% PAA in water. The silico-aluminate colloidal dispersion ls then stirred into this mixture. Perfume, dyes, and a 2.6% aqueous dispersion of MSAP are then added. The resultant composition is a translucent thixotropic gel with an apparent yield value of about 40–100 dynes/cm$^2$.

Homogeneity of the sample is improved by allowing for residual swelling of the neutralized polyacrylate for one day, prior to rheological measurements.

Samples containing aluminate are visibly thicker than those without. The aluminate appears to be increasing polymer interaction. As additive level of aluminate increases, sample smoothness begins to decrease. At higher levels of aluminate, the samples show signs of coagulation, graininess, or curdling, and the rheological thickening begins to reverse as the maximum benefit levels of aluminate are surpassed.

EXAMPLE III

Compositions made by Example II are stirred for homogeneity 24 hours after making and allowed to recover for about two hours before rheological readings are made. Apparent viscosities are read at ambient temperatures with a Brookfield RVT viscometer.

Yield values (shear rate at initial flow) are read first. A Helipath stand and a T-bar model B spindle are used with the RVT model viscometer. Apparent viscosities are calculated from standard tables from readings at 0.5 and 1.0 rpm. The apparent yield value is calculated by (viscosity at 0.5 rpm - viscosity at 1.0 rpm)/100.

Flowing viscosity values are read with a #6 spindle at 100 rpm after 30 seconds, using the standard conversion tables.

The following readings are typical for the above formulas:

| Polyacrylic Acid Type | 0% $Al_2O_3$ | 0.03% $Al_2O_3$ | 0.06% $Al_2O_3$ |
|---|---|---|---|
| | APPARENT YIELD VALUES | | |
| Carbopol 617 | 4 | 184 | 397 |
| Carbopol 616 | 0 | 48 | 316 |
| Carbopol 615 | 60 | 392 | 124 |
| Carbopol 940 | 4 | 84 | NA |
| Carbopol 941 | 128 | 76 | 484 |
| Carbopol 910 | 28 | 488 | 284 |
| | APPARENT VISCOSITIES | | |
| Carbopol 617 | 490 | 900 | 1320 |
| Carbopol 616 | 740 | 1260 | 1560 |
| Carbopol 615 | 860 | 1880 | 1590 |
| Carbopol 940 | 400 | 670 | NA |
| Carbopol 941 | 1390 | 1510 | 3750 |
| Carbopol 910 | 1640 | 4260 | 1380 |

These commercial Carbopol brand polyacrylic acids are produced by B. F. Goodrich. They vary in their properties as a function of average molecular weight and type and degree of polymer cross-linking.

It is seen from these data that a general trend of increasing viscosity and yield value are correlated with increasing level of $Al_2O_3$ as aluminate. Also, those grades which are initially thicker or more structured are seen to respond more dramatically to the lower levels of aluminate and exhibit drop-off of rheology as polymer aggregation or curdling occurs at the higher aluminate levels.

What is claimed is:

1. A liquid automatic dishwashing detergent composition having improved rheology comprising:

(a) from 0% to about 5% of a detergent surfactant;

(b) from about 5% to about 40% of a detergency builder material;

(c) a chlorine bleach ingredient to provide from 0% to about 2.5% of available chlorine based on the weight of the detergent composition;

(d) from about 0.25% to about 10.0% of a polycarboxylate polymer thickening agent having a molecular weight greater than about 500,000; and (e) from about 2% to about 15%, on a solids basis, of an alkali metal silico-aluminate colloidal dispersion, wherein the molar ratio of aluminum metal to $SiO_2$ is from about 0.01:1 to about 0.1:1;

said composition having an apparent yield value of from about 40 to about 800 dynes/cm$^2$.

2. The composition of claim 1 wherein the detergent surfactant is selected from the group consisting of $C_8$–$C_{18}$ alkyl sulfates, $C_8$–$C_{18}$ alkyl sulfonates, and mixtures thereof.

3. The composition of claim 1 wherein the detergency builder material is selected from the group consisting of sodium tripolyphosphate, sodium carbonate, potassium pyrophosphate, potassium carbonate, sodium pyrophosphate, and mixtures thereof.

4. The composition of claim 3 wherein the chlorine bleach ingredient is hypochlorite bleach.

5. The composition of claim 4 wherein the polycarboxylate polymer thickening agent is a polyacrylate thickener having a molecular weight greater than 750,000.

6. The composition of claim 5 wherein the silico-aluminate colloidal dispersion comprises from about 3% to about 10%, on a solids basis, of the composition.

7. The composition of claim 6 wherein the molar ratio of aluminum metal to $SiO_2$ is from about 0.02:1 to about 0.06:1.

8. A liquid automatic dishwashing detergent composition having improved rheology comprising:

(a) from about 0.1% to about 2.5% of a low-foaming detergent surfactant;

(b) from about 15% to about 30% of a detergency builder material;

(c) a chlorine bleach ingredient to provide from about 0.5% to about 1.5% of available chlorine based on the weight of the detergent composition;

(d) from about 0.5% to about 2% of a polyacrylate thickening agent having a molecular weight greater than about 750,000; and (e) from about 3% to about 10%, on a solids basis, of an alkali metal silico-aluminate colloidal dispersion, wherein the molar ratio of aluminum metal to $SiO_2$ is from about 0.02:1 to about 0.06:1;

said composition having an apparent yield value of from about 100 to about 600 dynes/cm$^2$.

9. A liquid automatic dishwashing detergent composition comprising:

(a) from about 4% to about 8% of sodium tripolyphosphate;

(b) from about 8% to about 15% of tetra potassium pyrophosphate;

(c) from 0% to about 8% of potassium carbonate;

(d) from 0% to about 6% of sodium carbonate;

(e) hypochlorite bleach in an amount to provide from about 0.5% to about 1.5% of available chlorine to the composition;

(f) from about 0.1% to about 2.5% of a low-foaming detergent surfactant;

(g) from 0% to about 3.5% of alkali metal hydroxide;

(h) from 0% to about 1.0% of an alkyl ester of phosphoric acid;

(i) from about 0.5% to about 1.5% of a polyacrylic polymer having a molecular weight greater than 750,000; and (j) from about 3% to about 10%, on a solids basis, of an alkali metal silico-aluminate colloidal dispersion wherein the molar ratio of aluminum metal to $SiO_2$ is from about 0.02:1 to about 0.06:1;

said liquid detergent composition containing no clay suspending agents and having an apparent yield value of from about 100 to about 600 dynes/cm$^2$.

10. The composition of claim 9 wherein the molar ratio of potassium to sodium salts in the composition is greater than about 0.45:0.55 to provide an essentially translucent composition.

11. The composition of claim 1 wherein preparation of the silico-aluminate colloidal dispersion comprises the following steps:

(a) dissolving an alkali metal aluminate in water;

(b) preparing an aqueous solution of alkali metal silicate having a solids content of from about 40% to about 50%;

(c) mixing the solution of (a) with the solution of (b) to produce a silico-aluminate colloidal dispersion wherein the molar ratio of aluminum metal to $SiO_2$ is from about 0.01:1 to about 0 1:1.

12. The composition of claim 11 wherein the molar ratio of aluminum metal to $SiO_2$ is from about 0.02:1 to about 0.06:1.

13. The composition of claim 12 wherein the alkali metal silicate is sodium silicate having an $SiO_2$:$Na_2O$ ratio of from about 1:1 to about 3.6:1.

14. The composition of claim 13 wherein the alkali metal aluminate is selected from the group consisting of potassium aluminate, sodium aluminate, and mixtures thereof.

* * * * *